US007043886B1

(12) United States Patent
Chubb

(10) Patent No.: US 7,043,886 B1
(45) Date of Patent: May 16, 2006

(54) REFRIGERATOR DOOR ASSEMBLY

(75) Inventor: Richard A Chubb, Gloucester City, NJ (US)

(73) Assignee: Thermoseal Glass Corp., Gloucester City, NJ (US)

( * ) Notice: Subject to any disclaimer, the term of this patent is extended or adjusted under 35 U.S.C. 154(b) by 0 days.

(21) Appl. No.: 10/337,492

(22) Filed: Jan. 7, 2003

(51) Int. Cl.
*E06B 3/68* (2006.01)
*E04C 2/54* (2006.01)
*E04C 2/38* (2006.01)

(52) U.S. Cl. ..... 52/656.4; 62/656.5; 62/204.5; 62/786.1; 312/138.1

(58) Field of Classification Search ..... 52/204.6, 52/204.593, 204.5, 786.1, 786.13, 656.4, 52/656.5; 312/116, 138.1, 401, 405, 406
See application file for complete search history.

(56) References Cited

U.S. PATENT DOCUMENTS 3,411,247 A * 11/1968 Fleming ..... 49/501
3,988,909 A * 11/1976 Catapano ..... 70/63
4,624,091 A * 11/1986 Biro ..... 52/656.5
4,689,933 A * 9/1987 Biro ..... 52/656.5
4,831,804 A * 5/1989 Sayer ..... 52/475.1
5,003,747 A * 4/1991 Morton ..... 52/656.5
5,113,628 A * 5/1992 Richardson et al. ..... 52/171.3
RE35,392 E * 12/1996 Richardson et al. ..... 52/172
5,636,484 A * 6/1997 DeBlock ..... 52/204.5
5,761,850 A * 6/1998 Lhotak et al. ..... 49/360
5,910,083 A * 6/1999 Richardson et al. ..... 52/171.1

* cited by examiner

*Primary Examiner*—Peter M. Cuomo
*Assistant Examiner*—Sarah C. Burnham
(74) *Attorney, Agent, or Firm*—John Lezdey & Assoc

(57) ABSTRACT

A refrigerator door assembly for mounting within an opening of a refrigerator cabinet for movement relative to the refrigerator consisting in combination the following components within a hollow rigid plastic welded structural door frame: a multi-paned insulated glass pack drop-in unit, a bushing means and a hinge means, each secured in the door frame and cooperating to support the dynamic and torsional loads of the glass pack unit.

9 Claims, 4 Drawing Sheets

REFRIGERATOR DOOR ASSEMBLY

FIELD OF THE INVENTION

The present invention relates generally to insulated glass doors and more particularly, to multi-pane insulated glass door assemblies such as used in commercial refrigerator and freezer units.

DESCRIPTION OF THE PRIOR ART

Current commercial refrigerators and freezers include glass door assemblies which comprise an insulated glass unit made up of two or more glass panes maintained in spaced-apart relation by tubular spacers with the interior between the panes appropriately sealed. Because the insulated glass doors are relatively heavy and require a sturdy and rigid frame for supporting their weight and for withstanding abusive repeated openings and closings that occurs in commercial establishments. The glass unit in turn is supported within a relatively rigid outer metallic frame, commonly formed from aluminum extrusions, with the metal frame overlapping the periphery of the glass unit for retaining the glass unit in position and for providing a decorative finished appearances to the door assembly. While improvements in energy efficiencies, structural rigidity, and mounting of such door assemblies have taken place over the years, such insulated glass door assemblies have remained substantially unchanged.

To provide necessary rigidity and durability in conventional refrigerator door assemblies, costly manufacturing procedures heretofore have been required. It is customary to first assemble the insulated glass unit and then fabricate the outer support frame thereon. The latter commonly requires accurate forming of mitered corners of the metal frame members and precision assembly techniques for establishing the necessary alignment. Such fabrication not only is expensive, but unless properly effected, during rigorous use of the door in commercial establishments, the components of the frame and glass unit can become separated and break the sealed condition of the glass unit. Moreover, because the outer support frame of such conventional doors is made of metal, it is highly heat conductive and can require electrical heating means for maintaining the portion of the frame exposed to the warmer ambient air at a sufficiently high temperature to prevent condensation build-up. Such electrical heating capability not only adds to the manufacturing cost of the door, it also increases the operating cost of the refrigerator unit.

To overcome some of the above problems associated with door frame members made of metal, non-metallic frames are generally manufactured from rigid polyvinyl chloride polymers (PVC) have been introduced for this purpose. However, structured rigidity of the PVC frames may be a problem since the interior portions are generally hollow or tubular structures must contain a desired reinforcement member or structure of many different types and configurations. In this concept, a reduced production cost is achieved by minimizing the thickness and cross-sectional perimeter of the rigid PVC.

U.S. Pat. No. 5,974,758 to Prelmeir discloses structures manufactured from plastic frames having hollow chambers reinforced with sheet metal inserts useful for producing doors and windows which allows external elements, such as metal fittings to be securely attached to the reinforcement members. In this type of mechanical framing system, the plastic cross-sections are assembled around a glass pack, which results in significantly higher labor, glass breakage, and complications in assembly. It also results in a completed door assembly that must be replaced in its entirety if the glass breaks or the seal fails in the field.

In addition to other advantages, which will be discussed hereinbelow, the present invention eliminates the need for mechanical fastening of mitered joints including the elimination of traditional steel, aluminum, or plastic "corner keys", internal metal or plastic stiffeners, and adhesive or hardware fasteners such as bolts or rivets to keep a mitered joint.

Therefore, there exists a need for a refrigerator swing door assembly which has a non-metallic outer, lightweight frame that rigidities the assembly, can be economically formed and that has the insulating properties required.

SUMMARY OF THE INVENTION

In accordance with the present invention there is provided a refrigerator door assembly for mounting within an opening of a refrigerator cabinet and particularly to multi-pane insulated door assemblies such as used in commercial refrigeration and freezer units which is non-metallic, lightweight and of easy construction yet provides an increased structural rigid configuration. Such improved desired characteristics are attained by the unique configuration of a hollow extruded rigid plastic structural door frame having spaced ribs formed on the internal surfaces for providing a snug or an interference fit for the hinge means which enables the hinge means and the glass pack unit to carry the heavy load of the glass pack unit. Furthermore, the space ribs assure a proper weld by spreading under the influence of a welding process. The unique configuration of the structural door frame also provides for rearwardly disposed shelf or ledge for drop-in mounting of the glass pack unit.

More particularly, the invention is directed to a refrigerator door assembly for mounting in an opening of a refrigerator cabinet comprising in combination:

Four hollow extruded rigid plastic frame members, each of said frame members terminating in a miter cut, each pair of adjacent frame members being secured by a weld forming a unitary structural support frame having spaced ribs on the internal surface, said structural frame having generally an L-shaped cross-sectional configuration defining an enclosed chamber for supporting at least one multi-glazed insulating glass unit having a separator between panes, and a recess adapted to receive a securing means for removably securing said insulated glass unit located along the inner perimeter of said structural frame; hinge means for movements of the refrigerator door relative to said cabinet; said structural frame having a lateral edge defining top, side, and bottom wherein the top and bottom edges have sockets for accommodating said hinge means, said sockets being in spatial communication with the enclosed chamber, said glazing unit is drop-in mounted.

Preferably, the hinge means components are housed or enclosed in cartridge form. On both components of the hinge means, i.e. hinge assembly and bushing assembly, the cartridges are inserted into the vertical stiles and must extend beyond the edges of the insulated glass pack unit.

It is therefore a primary object of the present invention to provide a door mounting structural frame for commercial refrigerators and freezers.

Another object of the present invention is a refrigerator door assembly which is non-metallic and lightweight which provides increased structural rigidity configuration or an increased resistance to deflection, and is of easy construction and repair.

A further object of the present invention is a novel refrigerator door construction which provides a relatively high strength door mounting frame that utilizes a hollow extruded ridge plastic welded frame to enable the weight of the glass pack unit to be supported by the interaction of the hinge means with the glass pack unit itself.

Other objects and advantages of the following detailed description of the preferred embodiments of the invention and upon reference of the accompanying drawings.

DETAILED DESCRIPTION OF THE PREFERRED EMBODIMENTS

Figure 1:
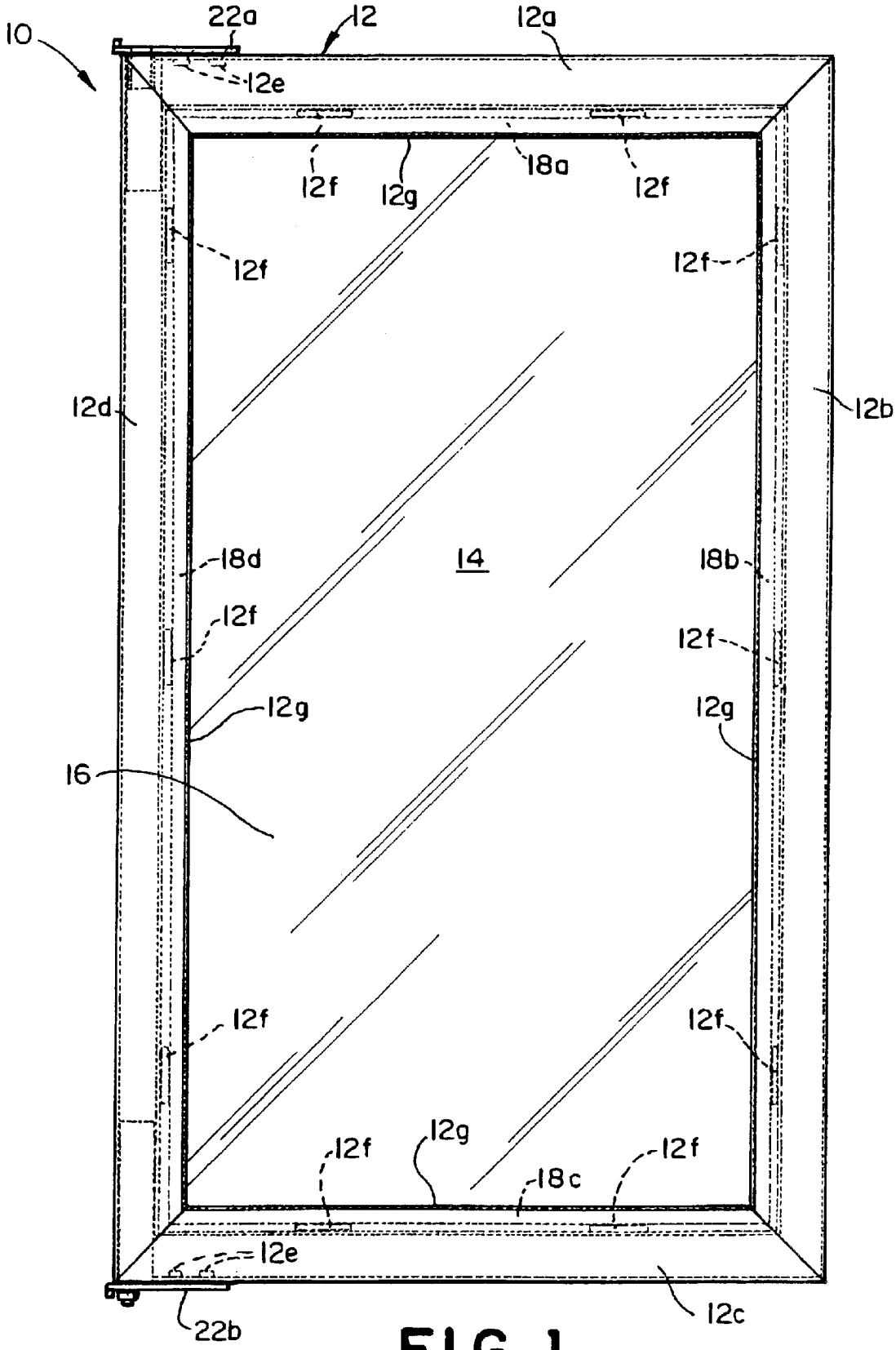
FIG. 1 is a front elevation view of a fragmenting section of a welded door frame containing both the hinge assembly and the bushing assembly each in cartridge form in accordance with the present invention.

Referring more particularly to FIG. 1 of the drawings, there is shown an illustrative refrigerator door assembly 10 comprising a welded extruded rigid plastic structural support frame 12 comprised of sections 12*a*, 12*b*, 12*c*, and 12*d* having a multi-glazed glass pack unit 16, load bearing hinge means 22*a* and bushing means 22*b* cooperating with said frame to carry out the full dynamic or torsional load of the door. It will be understood that the door assembly is particularly adapted for use in refrigerators and freezer cases or built in coolers or cabinets of the type used in supermarkets and other retail stores to display refrigerated or frozen commodities. The door assembly 10 is mounted for swinging movements in a door mounting frame which in turn is mounted within the opening of a wall of a refrigerator cabinet or the like (not shown). The door mounting frame generally extends about the periphery of the opening in the wall and defines sealing surfaces against which the free swinging side of the door assembly 10 engages when in a closed position.

Figure 3:
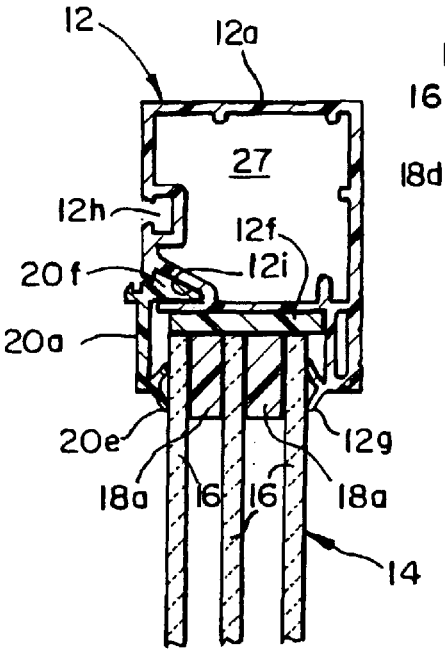
FIG. 3 is a cross sectional view showing the glass units within the structural frame taken along line 4—4.
Figure 6:
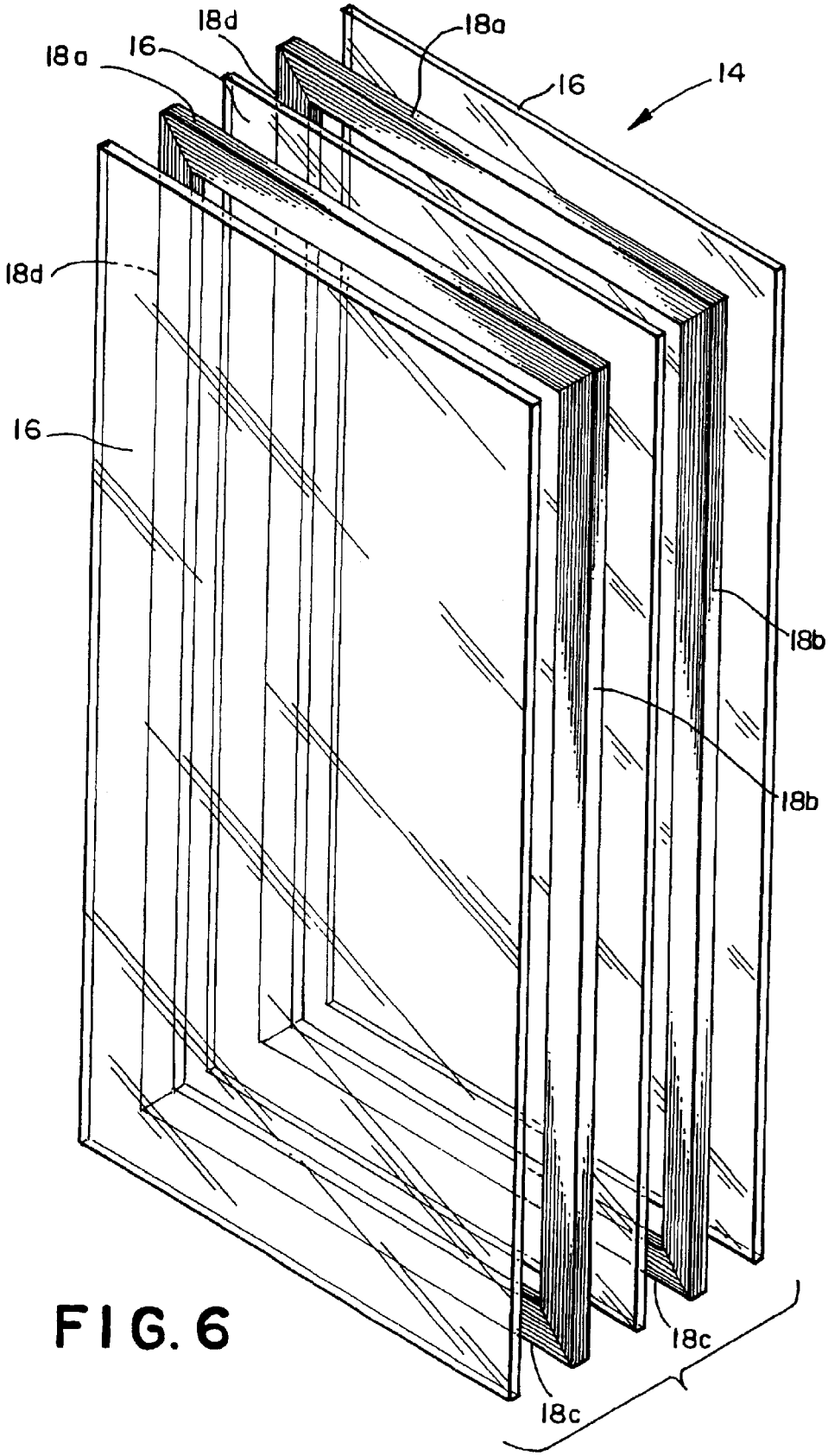
FIG. 6 is an exploded view of the refrigerator door showing the multi-layered insulating glass unit and the supporting frame.

The three glass panes 16 are separated by a frame comprising top and bottom sides 18*a*, 18*c*, and sides 18*b* and 18*d* as shown in FIG. 6. Plastic setting blocks 12 are inserted as vibration dampeners. As will be better seen in FIGS. 3 and 4, member 12*g* is a flexible plastic on an extension 12 of part 12 which dampers vibration on the outside panel.

The framing structure 12 of the door for the purposes of this application uses an extruded rigid polymer chloride (PVC) plastic. For fabrication of the structural door frame 12, the extruded PVC lengths are miter-cut diagonally at a forty-five degree angle. Four pieces 12*a*, 12*b*, 12*c*, and 12*d* per door are cut, two equally sized widths or horizontal pieces 12*b*, 12*d* (rails) and two equally sized heights or vertical pieces 12*a*, 12*c* (stiles). The tip-to-tip size of each length is cut longer than the actual finished size of the unit to allow for shrinkage during the welding process. This excess length varies by the type of plastic material used but is typically ⅛" to ¼" in excess. The frame lengths are measured and cut based on a formula that allows for the frame to accept an insulating glass (IG) pack unit of predetermined size by adding a factor for the width of the PVC extrusion in the vertical and horizontal dimensions of the glass unit.

After cutting the frame components, the four pieces 12*a*, 12*b*, 12*c*, 12*d* (two stiles and two rails) are heat fusion welded in the corners to form a structurally sound frame. This heat fusion welding process is conducted on a welding machine with either one, two or four corners being welded in a single welding cycle. In operation the welding process involves the application of heat and pressure to the corners to be joined by contacting a heated platen which is removed when sufficient heat is transferred to the edges and then are pressed together to form the welded bond. For rigid polyvinyl chloride the platen is maintained at temperatures from about 370° F. to about 395° F.

The welding cycle typically takes from 60 to 180 seconds-depending on the size and wall thickness of the individual extrusion, and the type and chemistry of the particular resin being fusion welded. These welded components become a secure, structurally sound "frame" following the welding process.

Other conventional plastic welding techniques may be used, for example by ultrasonic welding. A typical ultrasonic welding apparatus comprising an oscillating head and a sound reflector can be employed to create high energy concentration at the function between the frame members through ultrasonic vibrations to effect secure bonding and provide a structurally strong frame. Furthermore, ribs 26 provide adjacent material to assure a proper weld by spreading under the influence of the ultrasound and thus enhance the weld. In addition, the raised ribs 26 help assure a snug seating of the corner pieces.

After welding, the completed frame 12 is transferred to a vinyl weld corner-cleaning machine. Through a combination of internal scarfing blades and/or rotating saw blades or router bits, each welded corner is subjected to a cleaning process, which removes the excess residue on the inside and outside of each welded corner. This weld residue (or "weld flashing" or "weld burn-off") is a result of the welding process. Depending on the design of the machine, a weld corner cleaner can clean one, two, or four corners at a time. This process typically takes 30 to 180 seconds per frame.

Upon the completion of the weld cleaning, the frame 12 is prepared for subsequent installation of the threaded inserts (AVK AK series 10-32 inserts) and the cartridge hinge and brushing assemblies. This frame is placed in a custom-made double-ended router and hole driller to have the necessary openings created. Cycle time per unit is approximately 30 seconds for completion of a square slot for the hinge or bushing assembly, and two small (⅛" to 3/16") holes for the threaded inserts that will then accept a machine screw for fastening the hinge or bushing assembly flanges to the horizontal rails.

Figure 2:
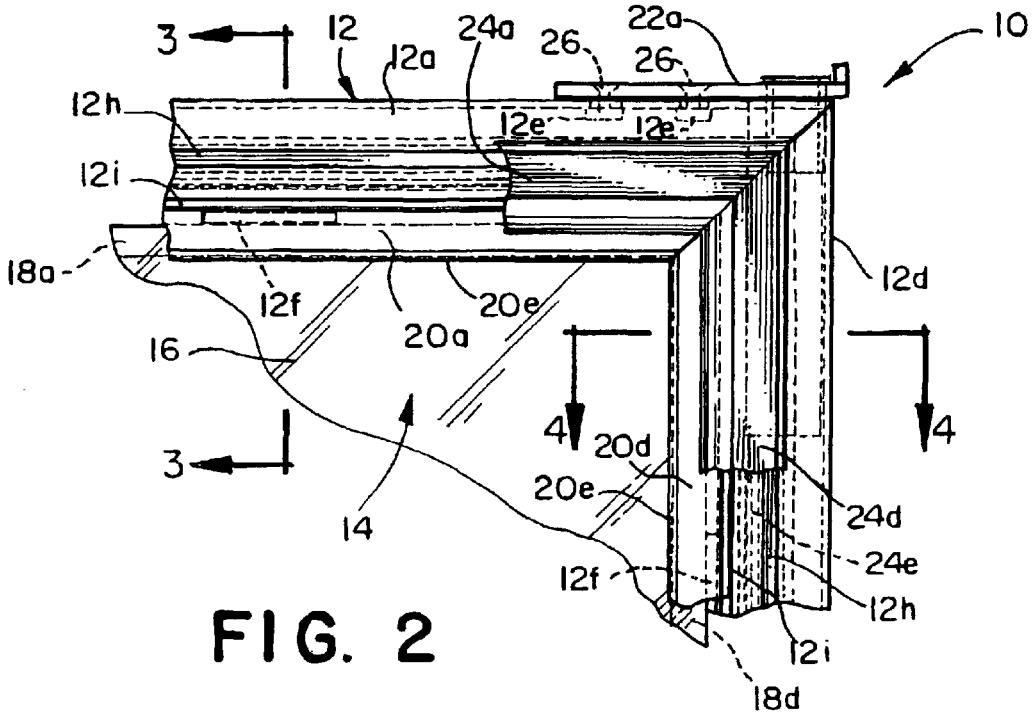
FIG. 2 is a sectional side view of the top of the insulated glass unit secured in the door frame showing the structural frame, the multi-layered insulating glass unit and hinge assembly.
Figure 5:
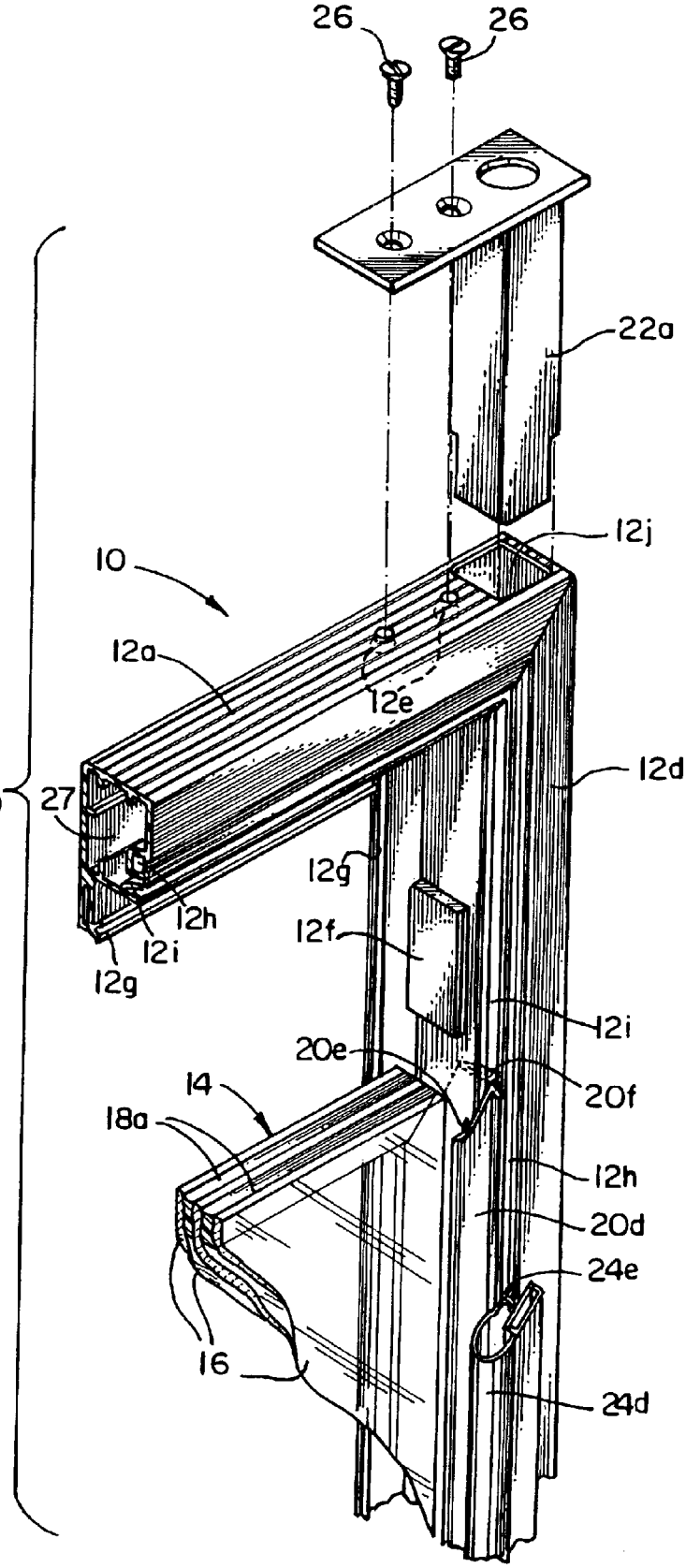
FIG. 5 is an exploded view showing the hinge assembly of FIG. 2.

As shown in FIGS. 2 and 5, the hinge and bushing assemblies 22*a* consist of a cast or forged hollow steel, square shaft/tube of approximately 4" length and 1" square stock that is formed with an adjacent "L"-shaped flat bar flange that is pre-drilled to accept hardware for attachment to the welded frame. By design the enclosed cavity 27 provides an interference for so that both assemblies are matched to cast or forged brackets that have unique openings to accept the retainer pins of the hinge or bushing assemblies and then attached with a retainer machine screw. These brackets are mounted adjacent an opening of a refrigerator or freezer cabinet. Suitable cartridge hinge and bushing assemblies are modifications of the self-closing hinge disclosed in U.S. Pat. No. 4,215,449, issued to Loilkitz, which is herein incorporated by reference.

The internal design of the hollow structural extruded frame 12 having generally an L-shaped cross-sectional configuration defining an enclosed chamber 27 provides a supported interference fit with the structural extruded frame, in order to prevent rotation of the hinge and bushing assemblies 22*a* inside the chamber. Furthermore, the enclosed chamber 27 provides a rearwardly positioned ledge for "drop-in" mounting of at least one multi-glazed insulating glass pack unit 30.

The hinge assembly 22*b* is typically installed in the bottom of the welded frame, and the bushing assembly 22*a* is typically installed in the top of the welded frame (FIG. 2). On both the hinge and bushing assemblies, the square structures insert into the vertical stiles, and extends beyond the insulating glass pack approximately 2" from where it rests inside the ledge of the sash extrusion. Note that the hinge and bushing assemblies can be reversed if needed, and will work on both left hand and right hand opening doors. Also, the hinge assemblies can be utilized with various tension ratings to accommodate various size and weight doors.

A cartridge hinge assembly 22*b* is arranged and constructed for mating with support bracket on the refrigerator opening which has a configuration rendering it suitable for attachment to the bottom left-hand edge of the door. However, the cartridge hinge assembly can be fitted for either left-hand or right-hand opening of the refrigerator or freezer door and either to the top or to the bottom edge of the door. Conversely, the cartridge bushing assembly 22*b* is positioned opposite than that of the cartridge hinge.

The hinge assembly can have an elongated housing holding a male cam member, a pivot pin within the cam member and extending through the lower end of the housing and a female cam member. The pivot pin passes through a housing so that the housing cam rotates relative to the male cam member as well as, relative to the pin. The female cam member is slidingly keyed to the housing by ridges on the lower cam member, housing having corresponding slots on the interior thereof. These slots may conveniently be provided proximate two vertical edges. This structure provides that the female cam member rotates with the housing relative to the male cam member and moves axially relative to the housing. The pivot pin protrudes though the upper portion of the housing into an accommodating opening in the support bracket. The structure of the cartridge hinge provides that the housing and the female cam member rotates with the door while the pivot pin and male cam member remain stationary when the door is opened and closed. However, the mating surfaces of the male cam member and the female cam member are so shaped that relative rotation of the cam members causes them to move apart in the axial direction. These cam members are based toward each other by a coil spring. This internal spring mechanism insures automatic closure of the door when it is opened and released during use. The coil spring is held under compression in the housing when the pivot pin is in a position relative to housing corresponding to the closed position of the door when the pivot pin is in a position of the door even when the door is slightly opened. The hinge assembly also includes a hold open feature that allows the door to remain open for loading and unloading the refrigerator or freezer. To engage this freezer, a door must be opened beyond the ninety degree open position.

The specific mechanical operation is more fully disclosed in U.S. Pat. No. 4,215,449 which is herein incorporated by reference. Operability of hinge assembly at either the left edge or the right edge of a door is provided by making the cams symmetrical with respect to each other. A further point to be noted is that the necessary restoring force is provided by a single hinge so that a similar hinge construction is not needed at the top of the door. Also since the hinge assembly is of the non-rising type, it can be used with the door frame in a wall. It will be noted that the pivot pin is held to a hinge assembly support plate only by means of machine screws 26, no provision for adjustment being necessary. Additionally, the force of the spring against the female cam member provides a strong and positive torque for closing the door particularly when one of the cam members has a low-coefficient-of-friction such as nylon.

Figure 4:
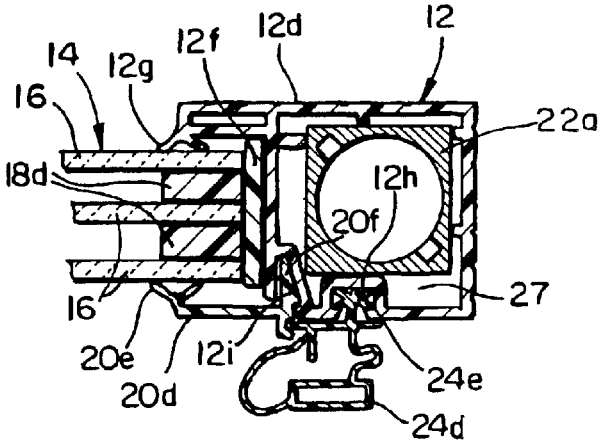
FIG. 4 is a cross sectional top view of the section shown in FIG. 3.

As seen in FIG. 4, the bushing assembly 22*a* is also in cartridge form, i.e. a hollow square shaft/tube to fit the enclosed cavity comprising a pivot pin, a low friction gasket and a retaining screw that fits into a matched or matching bracket.

The vertical relationship among the hinge and bushing assemblies 22*a*, each in cartridge form, and the glass pack unit 14 provides unexpectedly, a significant dynamic and static torsional load transfer from the upper bushing assembly along with bracket through the multi-pane glass pack unit 14 which is exceptionally strong and rigid in the plane of the glass pack unit 14 to the lower hinge assembly and hinge bracket.

This feature allows the extruded door frame to carry the heavy load of the glass pack unit without the need for traditional internal structural aluminum or steel stiffening or mechanical-type "corner-key" assemblies and associated fasteners. Essentially, the extension of the upper busing assembly past the top of the glass pack prevents the fusion-welded corner from carrying the full dynamic or static torsional loads of the glass pack/door assembly. In other words, even if the upper weld failed, the upper rail would need to separate from its threaded insert fasteners before the glass pack could break free from the overall frame assembly.

The reverse is true for the lower hinge assembly 22*b*, which is in compression due to load transfer from the static and dynamic loads of the glass pack in the door. If the lower weld broke, the glass pack would have no "push through" the hinge assembly and then tear the fasteners from the lower rail for the glass pack to break free from the frame assembly. In a mechanically fastened assembly, only the corner key need fail, or the fasteners let go or loosen, and the frame will fall apart during operation.

The unique construction of the refrigerator swing door assembly of this invention affords a "drop-in" glazing process. As described above the cross section of the extrusion is constructed in such a way as to allow the structurally sound welded frame to be created before the glass pack unit is installed. The cross section of the drop-in glazing sash typically resembles an "L" in that a ledge or shelf is incorporated for the glass pack unit to rest upon and on enclosed cavity to provide an interference fit for both the hinge and bushing assembly.

In practice, high durometer neoprene or similar cushioning or shock absorbing material provides setting blocks size which are placed 2 to 4 inches from the corner axis points of the welded frame structure 20. The multi-glazed glass pack unit is then positioned or dropped into the welded frame. The resulting gap 12*h* (FIG. 3) between the glass pack unit 14 and the setting blocks 12*b* is then filled with a sealant, preferably a silicone based sealant. The setting blocks serve as dams to prevent the sealant from spreading. A half-inch gap filing bead of sealant is then placed at the mid-point of each vertical stile to insure that no movement of the glass pack unit 14 will occur on the hinge or handle side of a vertical swing door.

After securing the glass pack unit 14 with setting blocks 12*b* and sealant (not shown) the door frame is completed with the installation of a snap-in extruded PVC glazing bead. FIG. 2 shows the bottom glazing bead 24*a*, 24*d*. The snap-in glazing bead members 24*a* and 24*d* are straight cut at the edges and installed by "snapping them into" channel 12*h* that is provided in the structural frame member. Glazing beads are installed between the door frame and the glass surface along the horizontal and vertical inner edges of the frame. They serve to secure the glass packs unit 14 into the structural frame member with uniform pressure around the perimeter of the door frame.

The first step in the installation of the hinge and bushing assembly involves inserting threaded inserts 26 (FIG. 2) by pneumatic means in holes 12*e* that were previously drilled into the top and bottom of rails 12*a*, 12*c*. In the next step, the hinge and bushing assemblies are positioned into their respective square sockets in the predetermined hinge side vertical stile until they are flush with the horizontal rails and flat support brackets are seated above their respective threaded inserts. The appropriate flat head screws 26 are installed through the flanges on the hinge and bushing assemblies and the refrigerator cabinet. The hinge assembly is affixed to the refrigerator cabinet by screws through bottom support bracket and the bushing assembly is secured in the same manner through the top support bracket.

For providing a seal between the refrigerator door and the cabinet frame when the door is in a closed position, a resilient sealing gasket 24*d* (FIG. 5) is inserted in channel 24*e* integrally around the perimeter on the rear side of the structural frame member. The sealing strip has a gasket portion which contains magnets for creating a magnetic attraction with the cabinet frame which may be made of stainless steel or other suitable magnetic material in a closed position.

To facilitate opening and closing of the door, a handle (not shown) is secured to the free swinging side of each door. A handle may be secured to the outer perimeter of the door by means of a fastener in threaded engagement with the outer frame member of the door.

The present invention is directed to a refrigerator or freezer door for mounting within a refrigerator or freezer cabinet fabricated from extruded rigid synthetic polymers suitable for large molded frames, such as from polyvinyl chloride, polypropylene or other such materials. Preferably a synthetic polymer approved for contact with food and beverage products by the National Sanitation Foundation are used for the purposes of this invention. Specifically a material marketed by Georgia Gulf and designated Georgia Gulf 5055 PVC is such an approved material and used in the construction of the present novel door. Furthermore, this plastic provides superior strength and weldability. Other additives approved for food or beverage contact may be added to the plastic formulation e.g. to provide fire-resistant properties.

The above description is considered only that of preferred embodiments. Modifications of these embodiments may well occur to those skillful in the art and to those who make or use the invention. Therefore, it is to be understood that the embodiments shown in the drawings and described above are merely for illustrative purposes and should not be used to limit the scope of the protected invention, which is defined by the following claims as interpreted by the statutes and priciples of patent law, including the doctrine of equivalents.

What is claimed is:

1. A refrigerator door assembly for mounting in an opening of a refrigerator cabinet comprising in combination:

four hollow rigid extruded plastic frame members, each of said frame members terminating in a miter cut, each pair of adjacent frame members being secured by a weld forming a unitary structural support frame having spaced ribs on an internal surface, said structural frame having generally an L-shaped cross-sectional configuration defining an enclosed chamber forming a ledge for supporting at least one multi-glazed insulated glass unit having a separator between panes, and a recess adapted to receive a securing means for removably securing said insulated glass pack unit extending along the inner perimeter of said structural frame; pivoting means mounted in said frame for movement of the refrigerator door for rotation to said cabinet comprising a cartridge hinge and bushing assembly at the top and bottom of said door extending past the glass unit; said structural frame having lateral edges defining top, side, and bottom wherein the top and bottom edges have sockets for accommodating pivot means, said sockets being in spatial communication with the enclosed chamber, whereby said glass unit is drop-in mounted within the frame.

2. The refrigerator door assembly of claim 1 wherein said hinge means automatically closes the door when it is opened and released.

3. The refrigerator door assembly of claim 1 including a sealant along the edges.

4. The refrigerator door assembly of claim 1 wherein the enclosed chamber includes spaced ribs provided on the internal surface.

5. The refrigerator door assembly of claim 4 wherein said spaced ribs provide an interference fit for the hinge means in cartridge form.

6. The refrigerator door assembly of claim 1 wherein said hinge means are inserted into sockets and internal chamber of said frame and extended beyond the edges of the insulated glass pack unit.

7. The refrigerator door assembly of claim 1 including vibration dampeners comprising plastic blocks.

8. The refrigerator door assembly of claim 1 wherein said enclosed chamber defines an interference fit between the frame and the hinge and bushing assemblies.

9. The refrigerator door assembly of claim 1 including a resilient seal around the periphery.

* * * * *